US010399346B2

(12) United States Patent
Arai et al.

(10) Patent No.: US 10,399,346 B2
(45) Date of Patent: Sep. 3, 2019

(54) LIQUID CONTAINER UNIT AND RECORDING APPARATUS

(71) Applicant: CANON KABUSHIKI KAISHA, Tokyo (JP)

(72) Inventors: Atsushi Arai, Yokohama (JP); Tomoki Yamamuro, Kawasaki (JP); Tatsuaki Orihara, Tokyo (JP); Takeho Miyashita, Yokohama (JP); Kazuya Yoshii, Yokohama (JP); Norihiro Ikebe, Kawasaki (JP); Akira Shiba, Machida (JP); Ryo Shimamura, Yokohama (JP); Masatoshi Ohira, Fujisawa (JP); Hirofumi Okuhara, Tokyo (JP); Kazumasa Matsushita, Kawasaki (JP); Misato Furuya, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 15/603,131

(22) Filed: May 23, 2017

(65) Prior Publication Data

US 2017/0361619 A1 Dec. 21, 2017

(30) Foreign Application Priority Data

Jun. 15, 2016 (JP) ..... 2016-118676

(51) Int. Cl.
*B41J 2/175* (2006.01)
*B41J 29/13* (2006.01)

(52) U.S. Cl.
CPC ..... *B41J 2/17523* (2013.01); *B41J 2/175* (2013.01); *B41J 2/1752* (2013.01);
(Continued)

(58) Field of Classification Search
CPC combination set(s) only.
See application file for complete search history.

(56) References Cited

U.S. PATENT DOCUMENTS 5,162,817 A 11/1992 Tajika et al. ..... 347/7
5,179,389 A 1/1993 Arai et al. ..... 347/7
(Continued)

FOREIGN PATENT DOCUMENTS

JP H08-290577 11/1996

OTHER PUBLICATIONS

U.S. Appl. No. 15/590,762, filed May 9, 2017.
(Continued)

*Primary Examiner* — Anh T Vo
(74) *Attorney, Agent, or Firm* — Venable LLP

(57) ABSTRACT

A liquid container unit includes: a liquid container including: a plurality of liquid storage portions; and a plurality of injection ports which are provided to the respective plurality of liquid storage portions, and are configured to enable injection of liquid into the plurality of liquid storage portions; and an injection port cover which is provided to the liquid container so as to be rotatable and is configured to cover the plurality of injection ports so as to be openable and closable, the injection port cover including a plurality of stopper members configured to close the plurality of injection ports when the injection port cover is closed.

20 Claims, 5 Drawing Sheets

(52) U.S. Cl.
CPC ..... *B41J 2/17509* (2013.01); *B41J 2/17553* (2013.01); *B41J 29/13* (2013.01)

(56) References Cited

U.S. PATENT DOCUMENTS

| | | | | |
|---|---|---|---|---|
| 5,355,158 | A | 10/1994 | Inada et al. | 347/22 |
| 5,381,169 | A | 1/1995 | Arai et al. | 347/33 |
| 5,398,054 | A | 3/1995 | Fukazawa et al. | 347/33 |
| 5,534,898 | A | 7/1996 | Kashino et al. | 347/33 |
| 5,606,354 | A | 2/1997 | Bekki et al. | 347/33 |
| 5,646,655 | A | 7/1997 | Iwasaki et al. | 347/17 |
| 5,748,207 | A | 5/1998 | Inui et al. | 347/43 |
| 5,777,649 | A | 7/1998 | Otsuka et al. | 347/94 |
| 5,831,652 | A | 11/1998 | Hinami et al. | 347/86 |
| 5,980,021 | A | 11/1999 | Nagoshi et al. | 347/49 |
| 5,984,449 | A | 11/1999 | Tajika et al. | 347/15 |
| 5,988,783 | A | 11/1999 | Tajika et al. | 347/7 |
| 6,015,203 | A | 1/2000 | Arai et al. | 347/33 |
| 6,050,669 | A | 4/2000 | Yano et al. | 347/23 |
| 6,241,350 | B1 | 6/2001 | Otsuka et al. | 347/94 |
| 6,345,888 | B1 | 2/2002 | Matsumoto et al. | 347/86 |
| 6,402,308 | B1 | 6/2002 | Hattori et al. | 347/86 |
| 6,476,926 | B1 | 11/2002 | Yano et al. | 358/1.14 |
| 6,505,923 | B1 | 1/2003 | Yamamoto et al. | 347/85 |
| 6,719,395 | B2 | 4/2004 | Iwasaki et al. | 347/19 |
| 8,529,035 | B2 | 9/2013 | Tsukamoto et al. | 347/86 |
| 8,529,037 | B2 | 9/2013 | Miyashita et al. | 347/86 |
| 8,770,730 | B2 | 7/2014 | Nanjo et al. | 347/86 |
| 8,770,731 | B2 | 7/2014 | Miyashita et al. | 347/86 |
| 8,894,182 | B2 * | 11/2014 | Osaki | B41J 2/1404 347/44 |
| 8,960,869 | B2 | 2/2015 | Takada et al. | 347/86 |
| 8,960,875 | B2 | 2/2015 | Shiba et al. | 347/93 |
| 9,016,842 | B2 | 4/2015 | Miyashita et al. | 347/86 |
| 9,126,779 | B2 * | 9/2015 | Osakabe | B65H 3/0684 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 9,463,633 | B2 * | 10/2016 | Osakabe | B41J 2/17513 |
| 9,475,298 | B2 * | 10/2016 | Osakabe | B41J 2/1752 |
| 9,479,660 | B2 * | 10/2016 | Osakabe | H04N 1/00567 |
| 9,597,884 | B2 | 3/2017 | Nanjo et al. | B41J 2/17546 |
| 9,663,319 | B2 * | 5/2017 | Osakabe | B65H 3/0684 |
| 9,844,947 | B2 * | 12/2017 | Osakabe | B41J 2/1754 |
| 2008/0309741 | A1 * | 12/2008 | Saikawa | B41J 2/17506 347/86 |
| 2011/0209335 | A1 | 9/2011 | Yamamoto et al. | 29/505 |
| 2011/0279545 | A1 * | 11/2011 | Osaki | B41J 2/1404 347/44 |
| 2015/0343793 | A1 | 12/2015 | Takada et al. | B41J 2/17556 |
| 2015/0352851 | A1 | 12/2015 | Shiba et al. | B41J 2/17513 |
| 2016/0089893 | A1 * | 3/2016 | Osakabe | B41J 2/17513 347/85 |
| 2016/0200114 | A1 | 7/2016 | Nanjo et al. | B41J 2/17546 |
| 2016/0347078 | A1 | 12/2016 | Kato et al. | B41J 2/175 |
| 2017/0087863 | A1 | 3/2017 | Miyashita et al. | B41J 2/17553 |
| 2017/0096010 | A1 | 4/2017 | Nanjo et al. | B41J 2/17546 |
| 2017/0120606 | A1 | 5/2017 | Koshikawa et al. | B41J 2/1754 |
| 2017/0120613 | A1 | 5/2017 | Ikebe et al. | B41J 2/17553 |

OTHER PUBLICATIONS

U.S. Appl. No. 15/332,604, filed Oct. 24, 2016.
U.S. Appl. No. 15/338,031, filed Oct. 28, 2016.
U.S. Appl. No. 15/353,238, filed Nov. 16, 2016.
U.S. Appl. No. 15/489,437, filed Apr. 17, 2017.
U.S. Appl. No. 15/489,445, filed Apr. 5, 2017.
U.S. Appl. No. 15/479,816, filed Apr. 5, 2017.
U.S. Appl. No. 15/625,960, filed Jun. 16, 2017.

* cited by examiner

LIQUID CONTAINER UNIT AND RECORDING APPARATUS

BACKGROUND OF THE INVENTION

Field of the Invention

The present invention relates to a liquid container unit for a liquid ejection device.

Description of the Related Art

As a liquid ejection device which is configured to eject liquid such as ink to a recording medium such as paper to record an image, there has been known an ink jet recording apparatus. In recent years, as a method of replenishing ink to the ink jet recording apparatus, there has been employed, other than a method of replacing an ink tank, a method of injecting ink into the ink tank from a view point of cost reduction. In Japanese Patent Application Laid-Open No. H08-290577, there is disclosed an ink tank which is reusable for any number of times through replenishment of ink. According to the disclosure of Japanese Patent Application Laid-Open No. H08-290577, the ink can be replenished with a spuit into the ink tank through an injection port, and the injection port can be closed with a lid member having a lock.

SUMMARY OF THE INVENTION

A liquid container unit according to one embodiment of the present invention includes: a liquid container including: a plurality of liquid storage portions; and a plurality of injection ports which are provided to the respective plurality of liquid storage portions, and are configured to enable injection of liquid into the plurality of liquid storage portions; and an injection port cover which is provided to the liquid container so as to be rotatable and is configured to cover the plurality of injection ports so as to be openable and closable, the injection port cover including a plurality of stopper members configured to close the plurality of injection ports when the injection port cover is closed.

Further features of the present invention will become apparent from the following description of exemplary embodiments with reference to the attached drawings.

DESCRIPTION OF THE EMBODIMENTS

In Japanese Patent Application Laid-Open No. H08-290577, there is disclosed only an ink tank for one color of ink, and there is no disclosure as to application to an ink jet recording apparatus capable of performing printing with inks of a plurality of colors.

Further, there arises a problem when the ink tank disclosed in Japanese Patent Application Laid-Open No. H08-290577 is directly applied to the ink jet recording apparatus capable of performing printing with inks of a plurality of colors. That is, when such an ink tank is prepared for each of a plurality of colors, and replenishment of ink is performed for one color after another, ink adhering to a distal end of the lid member is more liable to be touched by a user at the time of opening or closing the lid member so that a user's hand is stained.

Therefore, the present invention has an object to provide a liquid container unit capable of preventing a user's hand from being stained at the time of replenishment of liquid.

Now, embodiments of the present invention are described with reference to the drawings. However, sizes, materials, and shapes of components described in the following embodiments, and their relative positions, are subject to appropriate change in accordance with a configuration and various conditions of an apparatus to which the present invention is applied. Accordingly, it is not intended to limit the scope of the present invention only to those embodiments.

In Specification, a liquid container unit according to the present invention is described through description of a case where the liquid container unit is applied to an ink jet recording apparatus being a liquid ejection device. The ink jet recording apparatus is an apparatus which is configured to eject ink to a recording medium to record an image, and is applicable to office equipment such as a printer, a copying machine, and a facsimile, and to industrial production equipment. Through use of such an ink jet recording apparatus, recording can be performed with respect to various types of recording media such as paper, string, fiber, cloth, leather, plastic, glass, lumber, and ceramics.

"Liquid" as used herein shall be broadly construed, and means liquid which is, by being given onto a recording medium, available for formation of an image, a design, a pattern, or the like, processing of a recording medium, or treatment of ink or a recording medium.

(First Embodiment)

Figure 1:
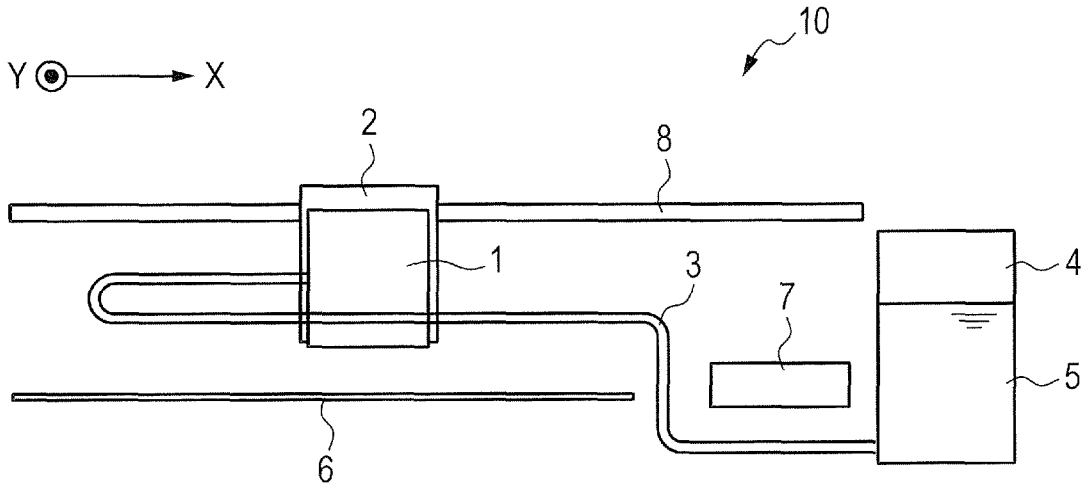
FIG. 1 is a schematic view for illustrating a configuration of an ink jet recording apparatus.

First, description is made of an ink jet recording apparatus to which the liquid container unit according to the present invention is applied. FIG. 1 is a schematic view for illustrating a configuration of the ink jet recording apparatus to which the liquid container unit according to the present invention is applied.

An ink jet recording apparatus 10 is a recording apparatus of a so-called serial scan type, and includes a recording head 1 and a carriage 2. The carriage 2 having the recording head 1 mounted thereon is supported so as to be movable on a guide rail 8 arranged along an X direction (main scanning direction), and is fixed to an endless belt (not shown) which moves in parallel to the guide rail 8. The endless belt reciprocates by a drive force of a carriage motor (not shown), thereby causing the carriage 2 to reciprocate in the X direction. The recording head 1 has a plurality of ejection ports configured to eject ink. The recording head 1 is configured to perform a recording operation to a recording medium 6, which is intermittently conveyed by a conveyance roller (not shown) in a Y direction (sub-scanning direction) orthogonal to the X direction, while reciprocating along with movement of the carriage 2.

Further, the ink jet recording apparatus 10 includes an ink-feeding tube 3 and a liquid container unit 4. The ink-feeding tube 3 is configured to feed ink to the recording head 1. The liquid container unit 4 is configured to store ink 5 which is to be fed to the recording head 1. The ink 5 stored in the liquid container unit 4 is fed to the recording head 1 through the ink-feeding tube 3 made of a flexible material.

Further, the ink jet recording apparatus 10 includes a recovery processing device 7 configured to recover and maintain an ink ejection state of the recording head 1. The recovery processing device 7 includes a capping mechanism and a pump mechanism. The capping mechanism is configured to cover the ejection ports of the recording head 1 through use of a cap. The pump mechanism is capable of sucking ink through the cap from the ejection ports.

Figure 2A:
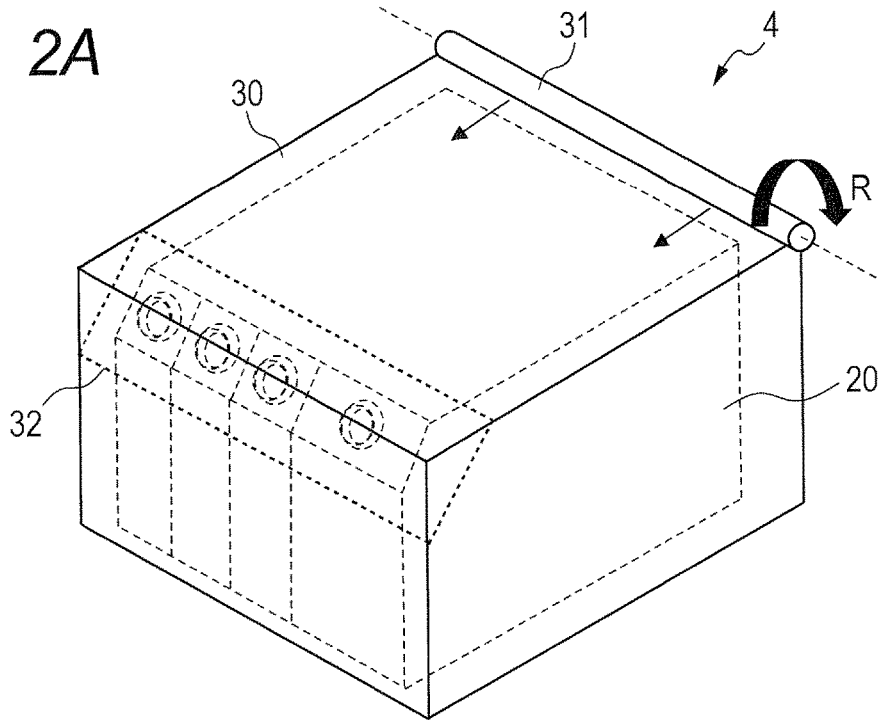
FIG. 2A is a schematic perspective view of a liquid container unit according to a first embodiment of the present invention.
Figure 2B:
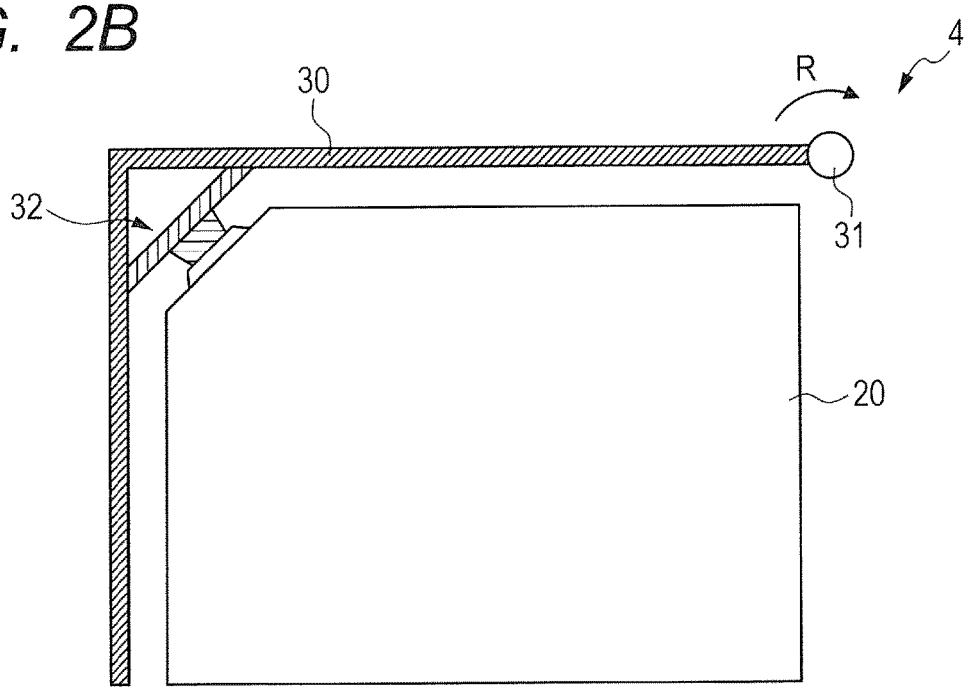
FIG. 2B is a schematic sectional view of the liquid container unit according to the first embodiment.
Figure 3A:
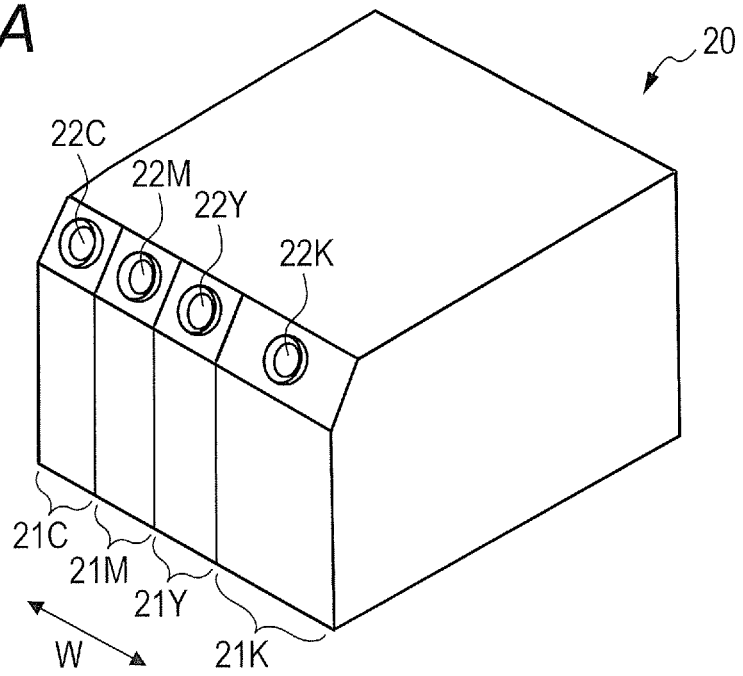
FIG. 3A is a schematic perspective view of a liquid container according to the first embodiment.
Figure 3B:
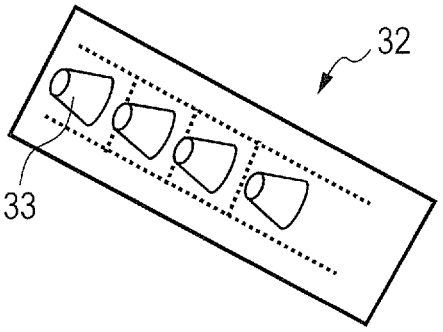
FIG. 3B is a schematic perspective view of a sealing member according to the first embodiment.

Next, with reference to FIG. 2A, FIG. 2B, FIG. 3A, and FIG. 3B, the liquid container unit according to the first embodiment of the present invention is described. FIG. 2A is a schematic perspective view of the liquid container unit according to the first embodiment. FIG. 2B is a schematic sectional view of the liquid container unit according to the first embodiment. FIG. 3A and FIG. 3B are schematic perspective views of a liquid container and a sealing member, respectively, which construct the liquid container unit according to the first embodiment.

The liquid container unit 4 includes a liquid container 20 and an injection port cover 30. The liquid container 20 is configured to store inks of a plurality of colors. In the illustrated example, as illustrated in FIG. 3A, the liquid container 20 includes four liquid storage portions 21C, 21M, 21Y, and 21K configured to store inks of cyan, magenta, yellow, and black, respectively. Further, the liquid storage portions 21C, 21M, 21Y, and 21K have injection ports 22C, 22M, 22Y, and 22K, respectively, for injection and replenishment of the inks. The injection ports are formed in respective inclined surfaces of the liquid storage portions. The injection port cover 30 is a cover configured to cover the injection ports 22C, 22M, 22Y, and 22K in an openable and closable manner, and is supported so as to be rotatable by a support member 31 which is provided in parallel to an array direction W of the liquid storage portions 21C, 21M, 21Y, and 21K. That is, the injection port cover 30 is arranged so as to be rotatable in an R direction with respect to the liquid container 20 about a center axis (rotary axis) S of the support member 31.

A sealing member 32 is provided on an inner side of the injection port cover 30. As illustrated in FIGS. 2A and 2B, the sealing member 32 is arranged at a position to be opposed to the injection ports 22C, 22M, 22Y, and 22K when the injection port cover 30 takes a closed position. As illustrated in FIG. 3B, the sealing member 32 includes a plurality of stopper members 33 configured to close the plurality of injection ports 22C, 22M, 22Y, and 22K. When the injection port cover 30 is closed, the stopper members 33 are press-fitted into the injection ports 22C, 22M, 22Y, and 22K to close the injection ports. With this, an inside of the liquid container 20 is isolated from outside air and sealed.

With such a configuration, the injection ports 22C, 22M, 22Y, and 22K can be exposed by only rotating the injection port cover 30 in the R direction illustrated in FIGS. 2A and 2B, thereby enabling replenishment of ink to the liquid container 20. Meanwhile, after the replenishment of ink is terminated, the injection ports 22C, 22M, 22Y, and 22K can be closed by rotating the injection port cover 30 in a direction reverse to the R direction, thereby being capable of reliably sealing the liquid container 20. In the first embodiment, the injection ports 22C, 22M, 22Y, and 22K can be opened and closed through the operation of rotating the injection port cover 30. Therefore, a user is less liable to touch peripheral portions of the stopper members 33 and the injection ports 22C, 22M, 22Y, and 22K which are stained with ink. Further, even when replenishment of inks of a plurality of colors is performed simultaneously, there is no need to perform the operation to the injection port cover 30 for times corresponding to the number of colors, thereby being capable of reducing possibility of touching ink at the time of operation to the injection port cover 30. As a result, a user's hand can be effectively prevented from being stained at the time of replenishment of ink.

It is preferred that the stopper members 33 be made of a material having rubber elasticity so that press-fitting to the injection ports 22C, 22M, 22Y, and 22K can be easily performed. As such a material, from a view point of favorable operability and sealability, it is preferred that chlorinated butylene rubber be used. It is more preferred that chlorinated butylene rubber having a rubber hardness of from 30° to 50°, in particular, of 40° be used.

(Second Embodiment)

Figure 4:
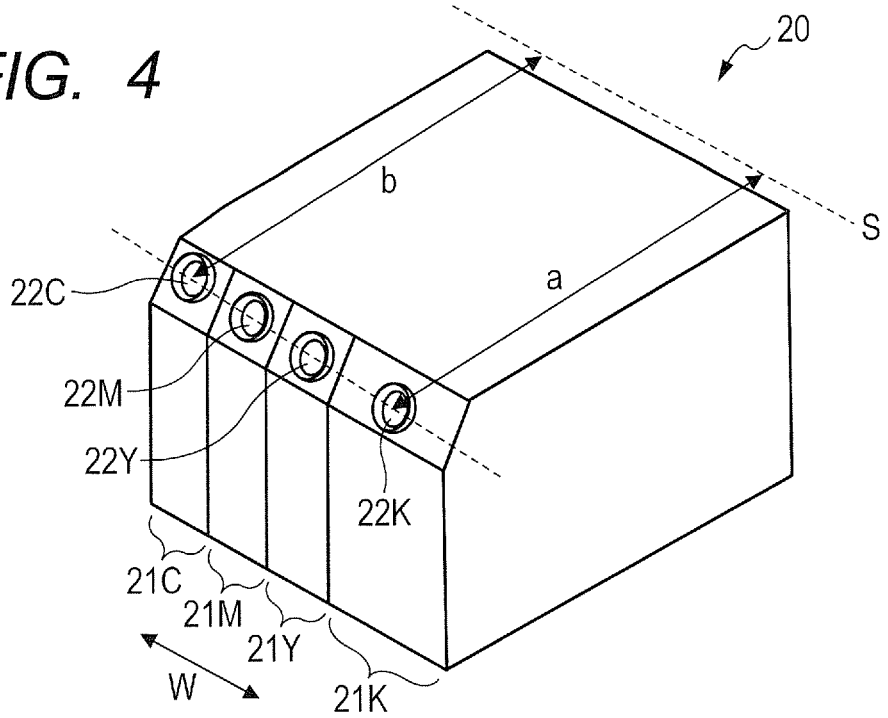
FIG. 4 is a schematic perspective view of a liquid container according to a second embodiment of the present invention.

FIG. 4 is a schematic perspective view of a liquid container according to a second embodiment of the present invention.

The second embodiment is a modification example of the first embodiment, and is a modification example in which the arrangement of the plurality of injection ports 22C, 22M, 22Y, and 22K is changed. Specifically, the second embodiment is different from the first embodiment in that the plurality of injection ports 22C, 22M, 22Y, and 22K are different from each other in radial distance from the rotary axis S of the injection port cover 30 (not shown) to respective centers of the injection ports (radial distance from the rotary axis to respective centers of the injection ports). More specifically, the plurality of injection ports 22C, 22M, 22Y, and 22K are arranged so that, as compared to a radial distance a from the rotary axis S to a center of the injection port 22K at one end, a radial distance b from the rotary axis S to a center of the injection port 22C at another end is smaller. Although not shown in FIG. 4, the arrangement of the plurality of stopper members 33 is similarly changed in accordance with the above-mentioned arrangement of the injection ports 22C, 22M, 22Y, and 22K.

With such a configuration, in the second embodiment, the injection ports 22C, 22M, 22Y, and 22K can be opened or closed at different timings by the stopper members 33 at the time of rotation of the injection port cover 30. That is, at the time of rotation of the injection port cover 30, the injection ports 22C, 22M, 22Y, and 22K are not simultaneously opened or closed, but can be opened in a descending order of the radial distances from the rotary axis S to the respective centers of the injection ports and can be closed in an ascending order of the radial distances. Therefore, as compared to the first embodiment in which all of the injection ports 22C, 22M, 22Y, and 22K are simultaneously opened or closed, an operating force to be exerted at the time of rotation of the injection port cover 30 can be reduced, thereby enabling the operation of rotating the injection port cover 30 to be easily performed. Further, the operating force can be reduced, and hence, even when the amount of press-fitting of the stopper members 33 is increased to improve the sealability, the injection port cover 30 can be operated with a smaller operating force as compared to the first embodiment. As a result, both the reliability of sealing by the stopper members 33 and operability of the injection port cover 30 can be achieved, thereby being capable of enjoying a merit of improvement in degree of freedom in design.

Further, in the second embodiment, as an injection port which is largest in radial distance from the rotary axis S to the center of the injection port and which is to be opened first when the injection port cover 30 is opened, there is arranged the injection port 22K corresponding to black ink which is ink of color having a lowest brightness. When the ink of color having a low brightness is mixed into ink of color having a high brightness, as compared to a case where ink of color having a high brightness is mixed into ink having a low brightness, color is significantly changed, and a resulting hue significantly differs from an original hue. In the configuration of the second embodiment, when the injection port 22K is opened, the injection ports 22C, 22M, and 22Y are closed. Thus, when the injection port 22K is opened, scattering of black ink adhering to a peripheral portion of the injection port 22K, entering of the scattered black ink into other injection ports 22C, 22M, and 22Y, and mixing of the black ink into other colors can be minimized.

In the illustrated example, the plurality of injection ports 22C, 22M, 22Y, and 22K are arranged along the array direction W of the liquid storage portions 21C, 21M, 21Y, and 21K in the descending order of the radial distances from the rotary axis S to the respective centers of the injection ports. However, the arrangement is not limited to such arrangement. Further, it is not necessary that all of the injection ports 22C, 22M, 22Y, and 22K be different from each other in radial distance from the rotary axis S to the respective centers of the injection ports. As long as at least two injection ports are different from each other in radial distance from the rotary axis S to the respective centers of the injection ports, the above-mentioned effect can be obtained. In the second embodiment, the radial distances from the rotary axis to the respective centers of the injection ports are different from each other, with the result that, at the time of rotation of the injection port cover 30, the injection ports 22C, 22M, 22Y, and 22K are opened or closed by the stopper members 33 at different timings.

(Third Embodiment)

Figure 5:
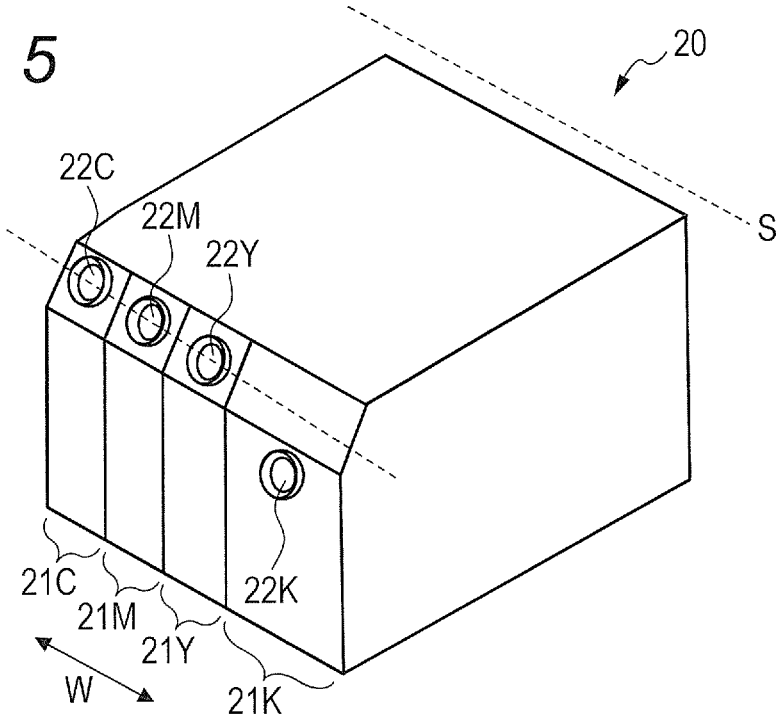
FIG. 5 is a schematic perspective view of a liquid container according to a third embodiment of the present invention.

FIG. 5 is a schematic perspective view of a liquid container according to a third embodiment of the present invention.

The third embodiment is a modification example of the second embodiment, and is a modification example in which a position of an injection port which is largest in radial distance from the rotary axis S of the injection port cover 30 (not shown) to the center of the injection port, that is, a position of the injection port 22K corresponding to the black ink is changed. Specifically, the injection port 22K is arranged on a plane which is different from a plane on which other injection ports 22C, 22M, and 22Y are arranged. Although not shown in FIG. 5, the arrangement of the plurality of stopper members 33 is similarly changed in accordance with the above-mentioned arrangement of the injection ports 22C, 22M, 22Y, and 22K.

As described above, in the third embodiment, the injection port 22K corresponding to the black ink which is ink having the lowest brightness can be arranged significantly apart from other injection ports 22C, 22M, and 22Y. With this, even when the black ink scatters along with opening of the injection port 22K, the possibility of causing the black ink to mix into inks of the other colors through the other injection port 22C, 22M, and 22Y can be further reduced. As a result, occurrence of failure in images such as color unevenness due to mixture of colors can be prevented.

The injection ports 22C, 22M, and 22Y other than the injection port 22K corresponding to the black ink may be different from each other or equal to each other in radial distance from the rotary axis S to the respective centers of the injection ports. Further, from the view point of preventing the influence of scattering of the black ink, the injection port cover 30 may be divided into, for example, two injection port covers so that only the injection port 22K corresponding to the black ink can be separately opened. That is, the injection port cover may be divided into a plurality of injection port covers corresponding to the plurality of liquid storage portions so that the divided injection port covers are individually openable and closable. For example, the injection port can be divided into two types of injection port covers including an injection port cover corresponding to two liquid storage portions and an injection port cover corresponding to one liquid storage portion. Further, in particular, as in the third embodiment, it is preferred that at least the injection port cover corresponding to the liquid storage portion configured to store liquid of a color having the lowest brightness be individually openable and closable.

(Fourth Embodiment)

Figure 6A:
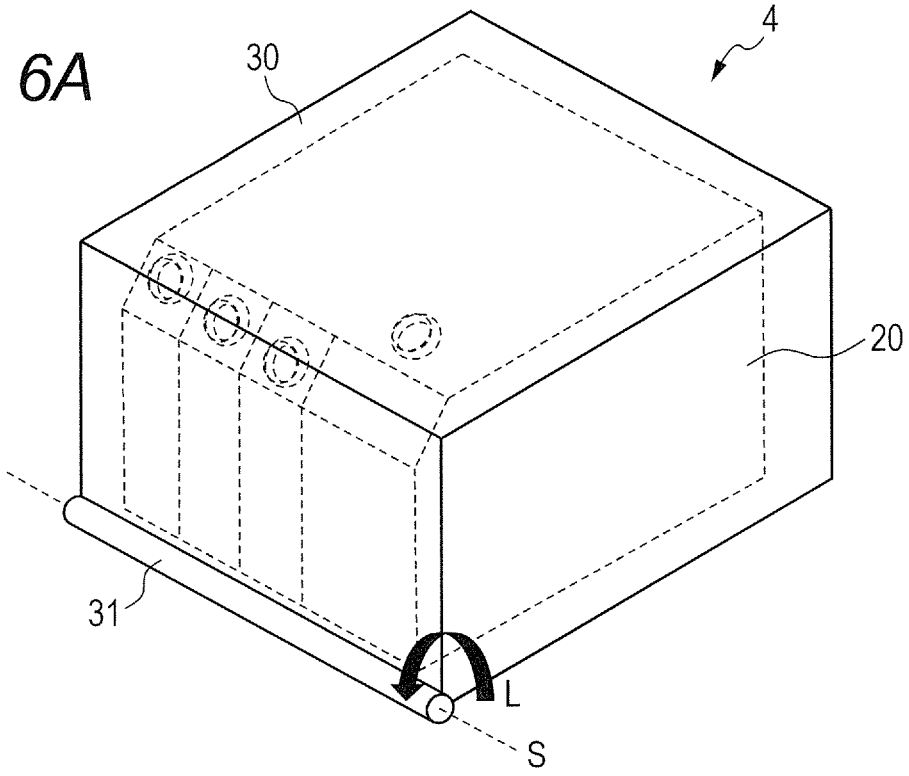
FIG. 6A is a schematic perspective view of a liquid container unit according to a fourth embodiment of the present invention.
Figure 6B:
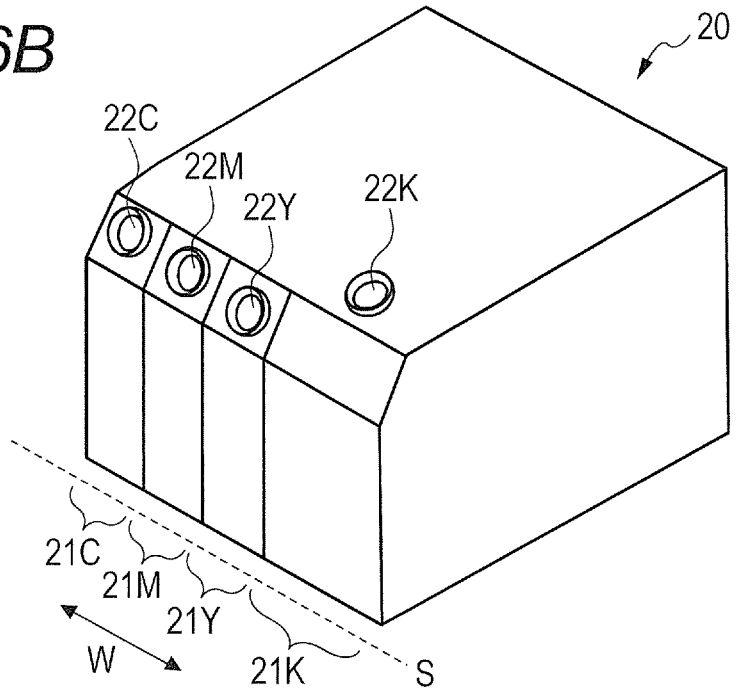
FIG. 6B is a schematic perspective view of a liquid container according the fourth embodiment.

FIG. 6A is a schematic perspective view of a liquid container unit according to a fourth embodiment of the present invention. FIG. 6B is a schematic perspective view of a liquid container according to the fourth embodiment.

In the above-mentioned embodiments, the support member 31 for the injection port cover 30, that is, the rotary axis S is arranged at a rear upper end of the liquid container 20. However, in the fourth embodiment, as illustrated in FIGS. 6A and 6B, the rotary axis S is arranged at a front lower end of the liquid container 20. In this case, the injection ports 22C, 22M, 22Y, and 22K can be opened by rotating the injection port cover 30 in an L direction illustrated in FIG. 6A, and can be closed by rotating the injection port cover 30 in a direction reverse to the L direction. In such a manner, the effect similar to that of the above-mentioned embodiments can also be obtained in the fourth embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-118676, filed Jun. 15, 2016, which is hereby incorporated by reference herein in its entirety.

What is claimed is:

1. A liquid container unit comprising:

a liquid container; and an integral injection port cover, wherein the liquid container comprises:

a plurality of liquid storage portions; and a plurality of injection ports which are provided to the respective plurality of liquid storage portions, and are configured to enable injection of liquid into the plurality of liquid storage portions; and wherein the integral injection port cover integrally includes a plurality of stopper members provided in one to one with the plurality of injection ports, and wherein by rotating the integral injection port cover with respect to the liquid container, a state of the plurality of stopper members changes between a state in which the plurality of injection ports are opened and a state in which the plurality of injection ports are closed.

2. A liquid container unit according to claim 1, wherein the injection port cover is rotatable with respect to the liquid container about a rotary axis parallel to an array direction of the plurality of liquid storage portions.

3. A liquid container unit according to claim 2, wherein at least two injection ports of the plurality of injection ports are different from each other in radial distance from the rotary axis to respective centers of the injection ports.

4. A liquid container unit according to claim 3, wherein the plurality of injection ports are different from each other in radial distance from the rotary axis to respective centers of the injection ports.

5. A liquid container unit according to claim 4, wherein the plurality of injection ports are arranged along the array direction in a descending order of radial distances from the rotary axis to the respective centers of the injection ports.

6. A liquid container unit according to claim 3, wherein an injection port, which is one of the plurality of injection ports and is largest in radial distance from the rotary axis to a center of the injection port, is an injection port of a liquid storage portion, which is one of the plurality of liquid storage portions configured to store liquids of a plurality of colors, and is configured to store liquid of a color having a lowest brightness.

7. A liquid container unit according to claim 6, wherein the color having the lowest brightness is black.

8. A liquid container unit according to claim 3, wherein an injection port, which is one of the plurality of injection ports and is largest in radial distance from the rotary axis to a center of the injection port, is arranged on a plane which is different from a plane on which other injection port is arranged.

9. A liquid container unit according to claim 2, wherein the injection ports are formed in an inclined surface of the liquid storage portion.

10. A liquid container unit according to claim 1, wherein the injection port cover comprises a plurality of injection port covers corresponding to the plurality of liquid storage portions, and the plurality of injection port covers are individually openable and closable.

11. A liquid container unit according to claim 10, wherein an injection port cover corresponding to a liquid storage portion, which is one of the plurality of liquid storage portions configured to store liquids of a plurality of colors, and is configured to store liquid of a color having a lowest brightness, is individually openable and closable.

12. A liquid container unit according to claim 1, wherein the plurality of stopper members are made of a material having rubber elasticity.

13. A liquid container unit according to claim 12, wherein the material having rubber elasticity comprises chlorinated butylene rubber.

14. A liquid container unit according to claim 1, wherein the injection port cover is rotatable with respect to the liquid container about a rotary axis, and the rotary axis is arranged on an upper end side of the liquid container.

15. A liquid container unit according to claim 14, wherein, when a side of the liquid container on which the injection ports are formed is a front side, and a side opposite to the front side is a rear side, the rotary axis is arranged on the rear side of the liquid container.

16. A recording apparatus, comprising:

the liquid container unit of claim 15; and a recording head configured to eject liquid fed from the liquid container unit.

17. A liquid container unit according to claim 1, wherein the injection port cover is rotatable with respect to the liquid container about a rotary axis, and the rotary axis is arranged on a lower end side of the liquid container.

18. A liquid container unit according to claim 17, wherein, when a side of the liquid container on which the injection ports are formed is a front side, and a side opposite to the front side is a rear side, the rotary axis is arranged on the front side of the liquid container.

19. A liquid container unit according to claim 1, wherein the injection ports are formed in an inclined surface of the liquid storage portion.

20. A recording apparatus, comprising:

the liquid container unit of claim 1; and a recording head configured to eject liquid fed from the liquid container unit.

* * * * *